US006848125B2

(12) United States Patent
Vila Corts

(10) Patent No.: US 6,848,125 B2
(45) Date of Patent: Feb. 1, 2005

(54) PREFABRICATED SWIMMING POOL

(75) Inventor: Francesc Xavier Vila Corts, Polinyá (ES)

(73) Assignee: Astral Pool Espana, S.A.U., Polinya (ES)

( * ) Notice: Subject to any disclaimer, the term of this patent is extended or adjusted under 35 U.S.C. 154(b) by 0 days.

(21) Appl. No.: 10/412,442

(22) Filed: Apr. 11, 2003

(65) Prior Publication Data

US 2003/0200602 A1 Oct. 30, 2003

(30) Foreign Application Priority Data

Apr. 25, 2002 (ES) ..... 200201160 U

(51) Int. Cl.[7] ..... E04H 4/00
(52) U.S. Cl. ..... 4/506
(58) Field of Search ..... 4/506; 52/169.7, 52/169.8

(56) References Cited

U.S. PATENT DOCUMENTS 1,786,613 A 12/1930 Hooper
2,534,414 A 12/1950 Hall ..... 4/172.19
3,335,430 A * 8/1967 Schwarz et al. ..... 4/506
3,530,512 A 9/1970 McBride ..... 4/172.19
3,534,414 A * 10/1970 Hall ..... 52/169.7
4,400,834 A * 8/1983 Corna et al. ..... 4/506
5,010,603 A * 4/1991 Hertzog ..... 4/506

FOREIGN PATENT DOCUMENTS

FR 2439856 5/1980
GB 1451324 9/1976

* cited by examiner

*Primary Examiner*—Charles E. Phillips
(74) *Attorney, Agent, or Firm*—Steinberg & Raskin, P.C.

(57) ABSTRACT

A swimming pool comprising a perimetral structure supporting the water holder being made of plastics material and is characterized in that the perimetral structure is apt to rest on the surface on which the swimming pool is to be installed, the perimetral structure comprising tensioning members being fitted to it and transversally arranged from side to side of the perimeter in an underlying arrangement. The perimetral structure comprises base supports being transversally arranged along the swimming pool perimeter and joined together by means of a backwardly arranged side member, the base supports frontally supporting the panels that will make up the swimming pool contour. The tensioning members are made up of ropes being provided with means to adjust their tensioning.

6 Claims, 3 Drawing Sheets

PREFABRICATED SWIMMING POOL

BACKGROUND OF THE INVENTION

There are different prefabricated swimming pool models basically comprising a perimetral structure being apt to be secured to the ground and supporting a water holder being made of a flexible plastics material and also known as the "liner". The perimetral structures comprise panels forming the swimming pool contour.

DESCRIPTION OF THE INVENTION

This invention has as its object a prefabricated swimming pool being apt to allow a quick assembly and not requiring to be secured to the ground and hence being apt to be installed on any surface without damaging it, and to be dismantled in order to be stowed away or to be installed somewhere else. This swimming pool is of big dimensions thus being adequate to be used for holding swimming championships, the swimming pool basically comprising a tensioner arrangement assuring the stability of the structure in face of the pressure being exerted by the big quantity of water being contained in it.

This particular construction of the swimming pool allows to install it in the inside of sports pavilions since no damage of any description is caused to them.

The perimetral structure of this swimming pool does basically comprise tensioning members being fitted to it and transversally arranged from side to side of the perimeter in an underlying arrangement, the structure at that level comprising base supports being transversally arranged along the swimming pool perimeter and joined together by means of a backwardly arranged side member, the supports frontally supporting the panels that will make up the swimming pool contour.

Several of the base supports, the side member joining them together and the panels being supported by them advantageously form modules that in a mutually adjacent arrangement will form the swimming pool contour.

The tensioning members will be preferably made up of ropes being provided with means to adjust their tensioning.

On the back face of the panels a support has been provided for a perimetral overflow channel, the back face also having fitted to it a lower tie bar and a diagonal brace as well as other reinforcing members all of them being of adjustable length.

These and other characteristics will be best made apparent by the following detailed description whose understanding will be made easier by the accompanying three sheets of drawings showing a practical embodiment being cited only by way of an example not limiting the scope of the present invention.

DETAILED DESCRIPTION OF THE INVENTION

Figure 1:
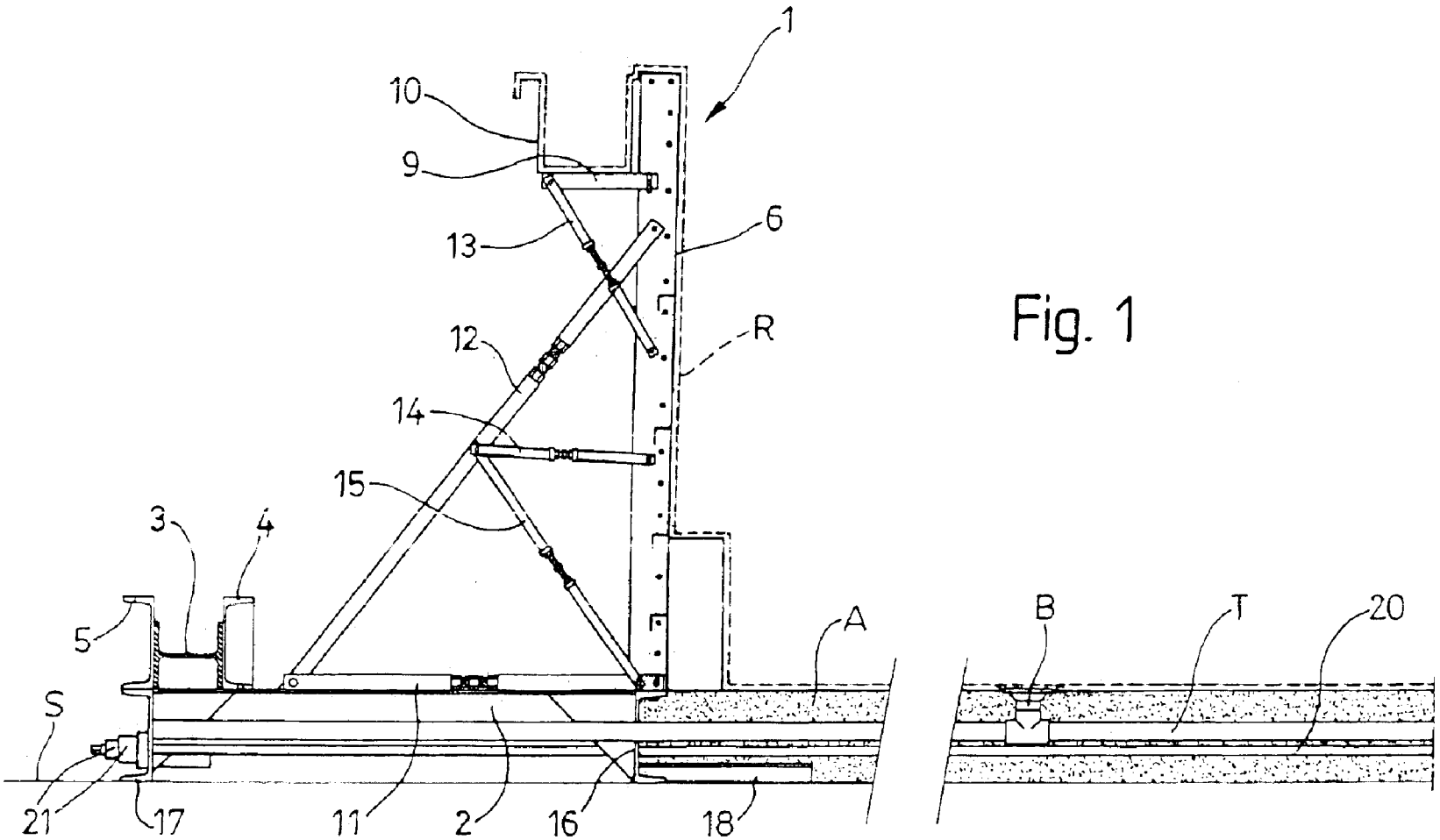
FIG. 1 in a sectional elevation illustrates the perimetral structure of the swimming pool.
Figure 2:
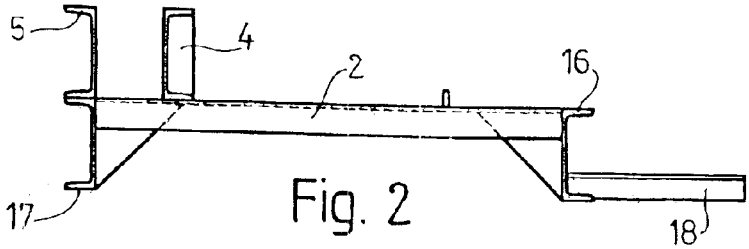
FIGS. 2 and 3 show a base support in an elevational view and in a plan-view, respectively.
Figure 3:
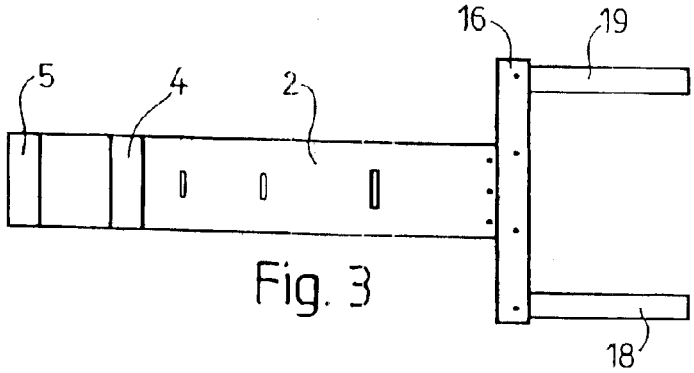
Figure 4:
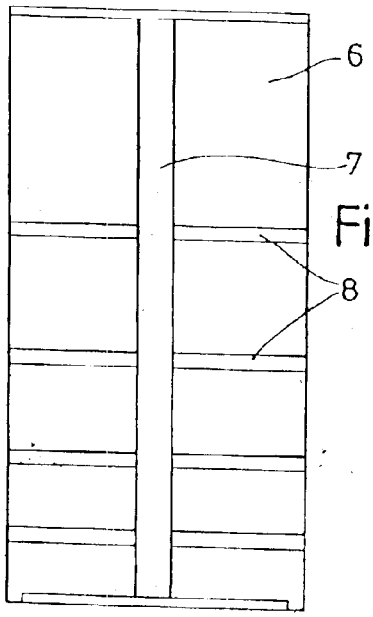
FIGS. 4 and 5 represent a panel in an elevational back view and in a plan-view, respectively.
Figure 6:
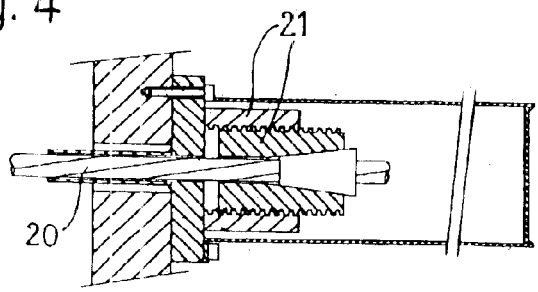
FIG. 6 in a sectional elevation illustrates in detail the fitting up of the tensioning rope ends.
Figure 5:
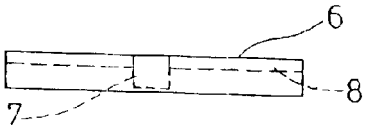

According to the drawings this prefabricated swimming pool consists of a perimetral structure 1 supporting a water holder R being made of plastics material (aka "liner").

This perimetral structure is apt to rest on the surface S on which the swimming pool is to be installed and comprises base supports 2 being transversally arranged along the swimming pool perimeter and joined together by means of a backwardly arranged side member 3 being formed by an H-section being fitted between two channels 4 and 5 being solid on top of the base supports 2, these latter frontally supporting the panels 6 that will make up the swimming pool contour, the panels being made of hot-dip galvanized steel and having a rectangular format with a longitudinal reinforcing section 7 and other transversal sections 8.

Attached to the back face of the panels 6 is a support 9 for a perimetral overflow channel 10, the back face also having fitted to it a lower tiebar 11 and a diagonal brace 12 as well as other reinforcing members 13, 14 and 15 all of them being of adjustable length.

Each of the base supports 2 rests on the ground with two end channels 16 and 17, the front channel 16 of a bigger length determining a perimetral divider being provided in the structure and serving the purpose of retaining the sand A being arranged in a compacted arrangement on the ground S and forming the base supporting the bottom of the holder R, two lower arms 18 and 19 extending from the ends of the channel 16 towards the inside of the swimming pool.

The perimetral structure 1 comprises tensioning members 20 being fitted to it and transversally arranged from side to side of the perimeter in an underlying arrangement, the tensioning members being made up of steel ropes being provided at their ends with hydraulic means (not shown) allowing to adjust their tensioning and comprising a thread device 21 allowing to more accurately adjust the tensioning.

Figure 7:
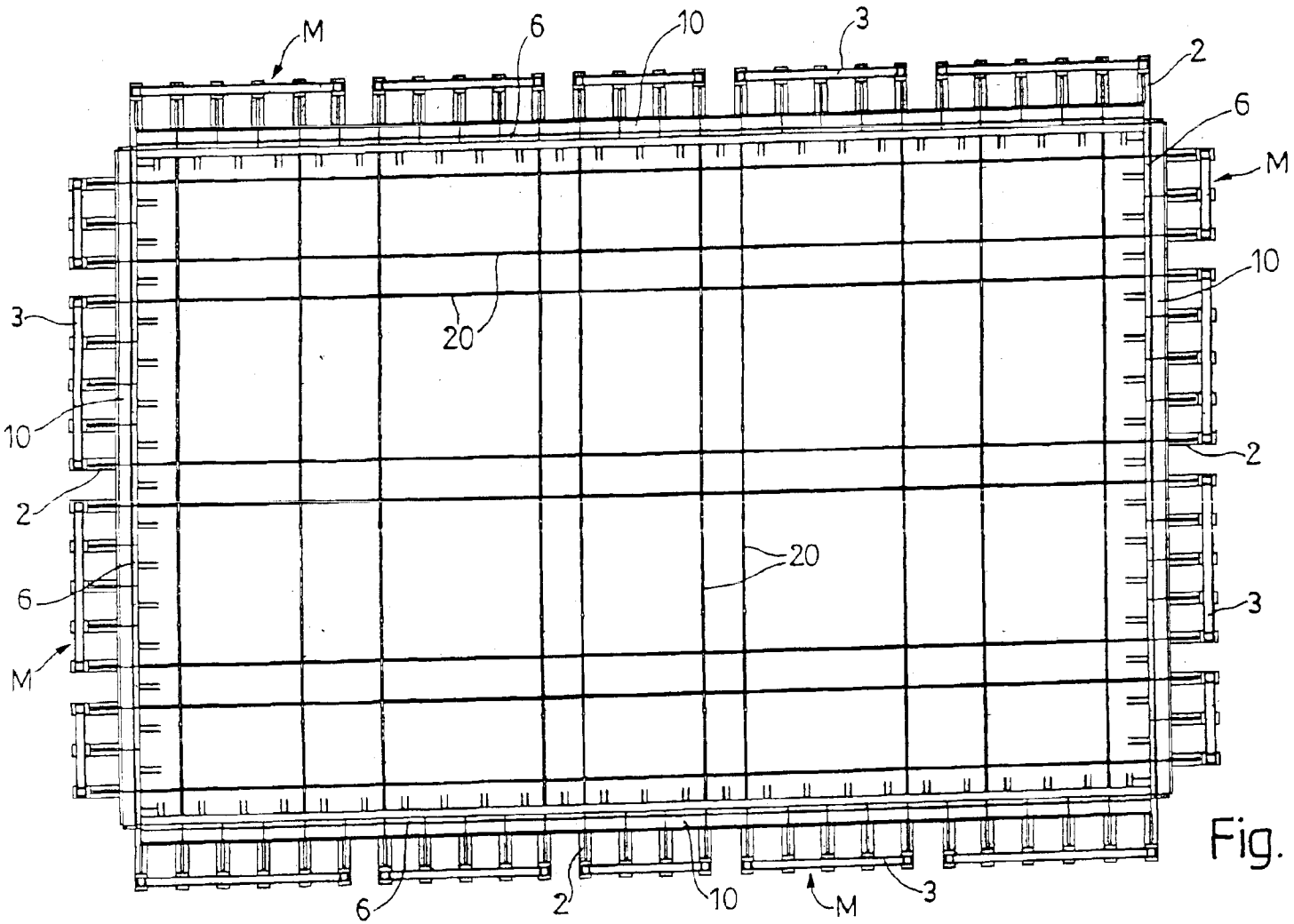
FIG. 7 is a plan-view of the whole perimetral structure of a swimming pool.

As shown in FIG. 7 the perimetral structure is formed by modules M each of which comprises several base supports 2, a side member 3 and several panels 6.

The edges of the holder R do also cover the perimetral overflow channel 10 thus avoiding water losses.

Most of the components of this perimetral structure are joined together by means of bolts, and hence they can be easily dismantled in order to be used on another occasion in the future.

In a thus built swimming pool the water re-circulation will be carried out in the same way as in a conventional swimming pool, this is to say that once having been filtered and treated the water will be returned to the swimming pool through an underlying piping system T and nozzles B being provided at the swimming pool bottom.

The invention can within its essentiality be put into practice in other embodiments only in detail differing from the one having been described above only by way of example, the other embodiments also falling within the scope of the protection being sought.

What is claimed is:

1. A prefabricated swimming pool comprising:

a perimetral structure supporting a water holder being made of plastics material, wherein the perimetral structure is adapted to rest on a surface on which the swimming pool is to be installed and comprises tensioning members being fitted to it and transversally arranged from side to side of a perimeter of the swimming pool in an underlying arrangement; wherein the perimetral structure comprises base supports being transversally arranged along the swimming pool perimeter and joined together by means of a backwardly arranged side member, said base supports frontally supporting panels that will make up the swimming pool contour, and said base supports being provided with two arms arranged toward the inside of the swimming pool such that a bottom of the swimming pool rests on the two arms on sand.

2. A prefabricated swimming pool according to claim 1, wherein a back face of the panels also having fitted to it a lower tiebar and a diagonal brace as well as other reinforcing members all of them being of adjustable length.

3. A prefabricated swimming pool according to claim 1, wherein each of the base supports rests on the ground with two end channels, the front channel determining a perimetral divider being provided in the structure and serving a purpose of retaining the sand being arranged in a compacted arrangement on the surface and forming the base supporting the bottom of the holder.

4. A prefabricated swimming pool according to claim 1, wherein the tensioning members are made up of steel ropes being provided with means allowing to adjust their tensioning.

5. A prefabricated swimming pool according to claim 1, wherein the perimetral structure is made up of modules each of which comprises several base supports, a side member and several panels.

6. A prefabricated swimming pool according to claim 1, wherein the edges of the water holder also cover a perimetral overflow channel.

* * * * *